United States Patent [19]

Hungerford

[11] 4,019,455

[45] Apr. 26, 1977

[54] SHANK MOUNTED FOULED ANCHOR RELEASE

[75] Inventor: Daniel Comstock Hungerford, N. Palm Beach, Fla.

[73] Assignee: Brunswick Corporation, Skokie, Ill.

[22] Filed: Jan. 28, 1976

[21] Appl. No.: 653,160

[52] U.S. Cl. ..... 114/298

[51] Int. Cl.[2] ..... B63B 21/46

[58] Field of Search ..... 114/206 R, 207, 208 R; 52/162, 163

[56] References Cited

UNITED STATES PATENTS

| | | | |
|---|---|---|---|
| 1,899,866 | 2/1933 | Harvey | 114/208 R |
| 2,468,077 | 4/1949 | Kellum | 114/208 R |
| 3,030,907 | 4/1962 | Rosselle | 114/208 R |
| 3,182,625 | 5/1965 | White | 114/208 R |

*Primary Examiner*—Trygve M. Blix
*Assistant Examiner*—Jesus D. Sotelo
*Attorney, Agent, or Firm*—Malin & Haley

[57] ABSTRACT

A shank-mounted reverse pull slide and slide stop to effect release of a fouled anchor. The device can be readily mounted on a substantially solid, conventional twin fluke anchor shank without altering the structural integrity of the shank. The slide housing has interior wall surfaces which are shaped to provide a shank contact portion and a plurality of passages between the shank surface and the slide housing walls to prevent sand and other marine grit from jamming or restricting movement of the slide along the shank in a marine environment. The slide stop is mounted within the conventional shank line receiving aperture or eye and includes a shear pin receiving channel. When utilized with a shear pin, the slide is locked near the shank free end and cannot move along the shank until the shear pin is severed. Without the shear pin, the slide is moveable between the slide stop and the shank end connected to the crown. The shear pin is easily installed or removed to accommodate either mode of operation.

19 Claims, 9 Drawing Figures

Fig. 2.
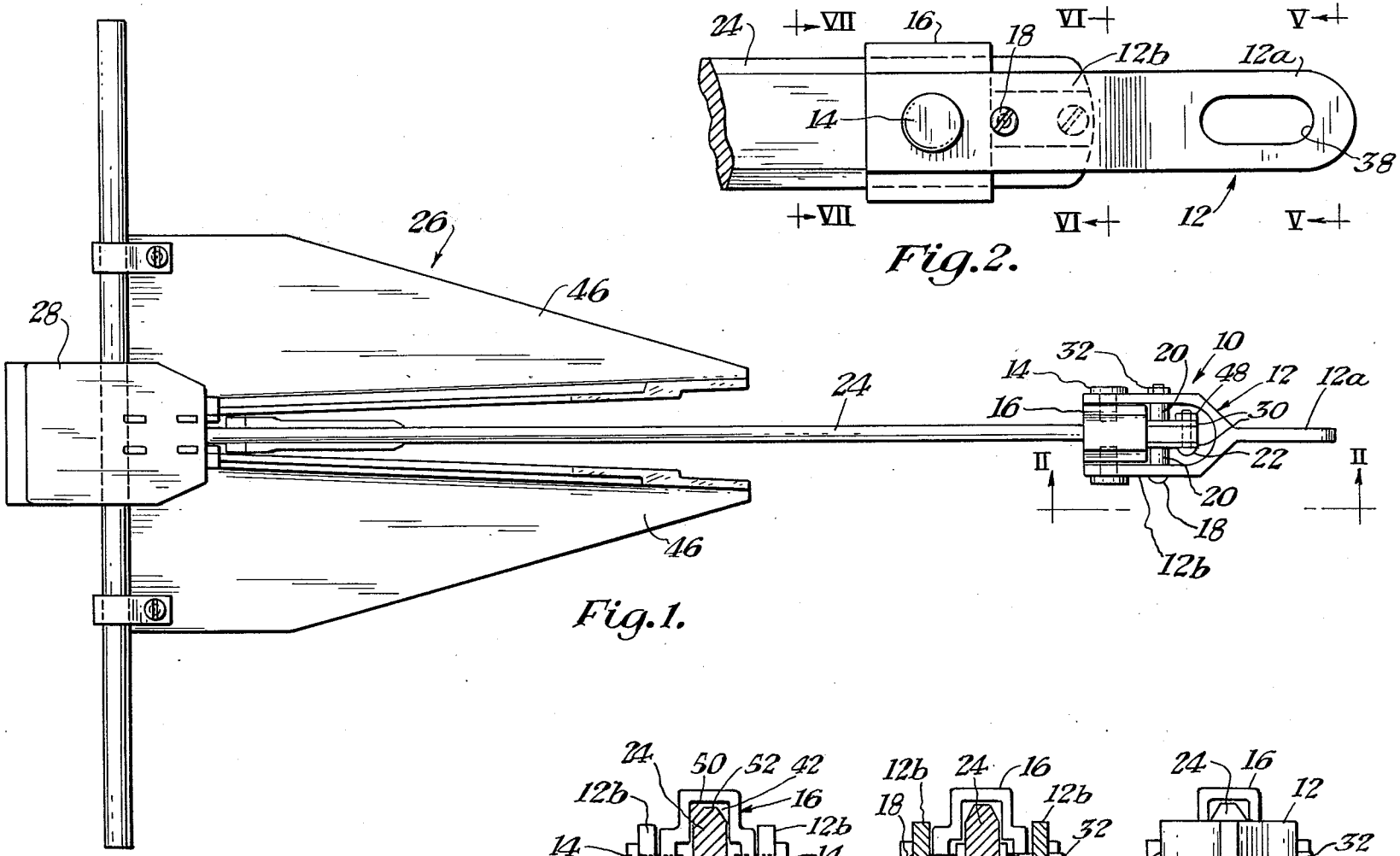
Fig. 1.
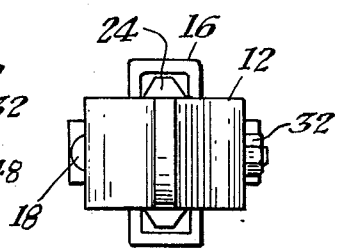
Fig. 5.
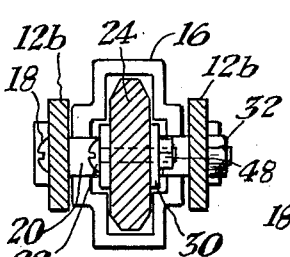
Fig. 6.
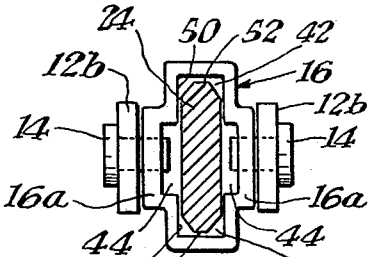
Fig. 7.

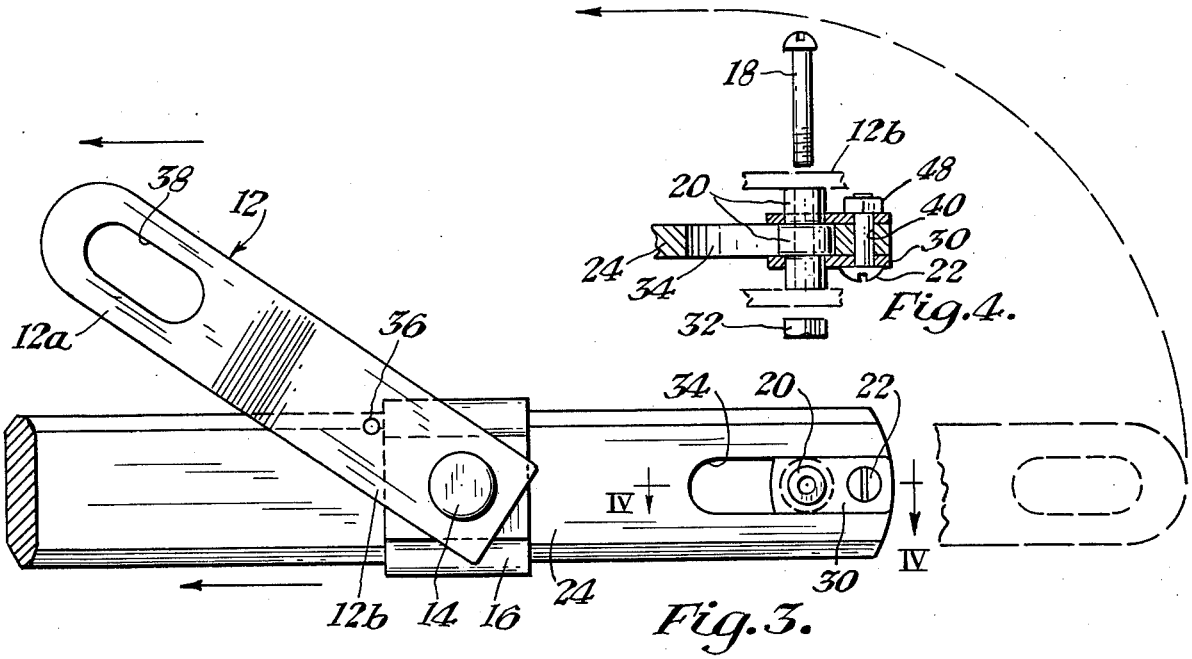
Fig.4.
Fig.3.
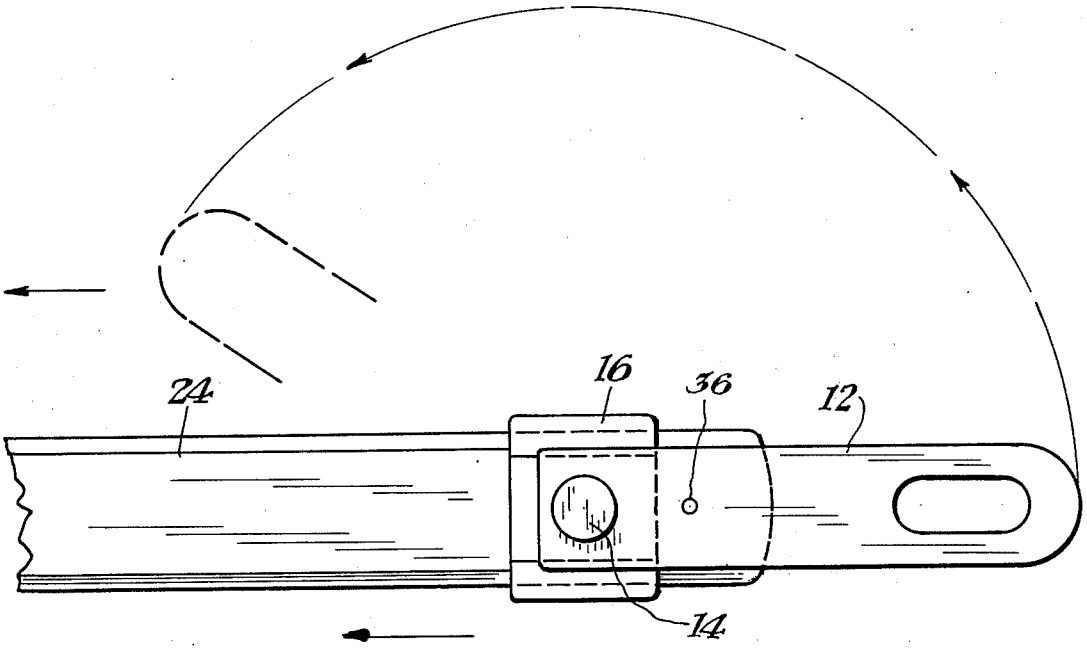
Fig. 9.

SHANK MOUNTED FOULED ANCHOR RELEASE

BACKGROUND OF THE INVENTION

This invention relates generally to a slide for a conventional twin fluke-type anchor which is mountable on the anchor shank to provide for reverse pull on the anchor for releasing the anchor if snagged or fouled on rocks, coral or the like, and specifically to a device that is readily installable on a conventional anchor shank to provide a reverse pull shank slide which does not reduce the structural integrity of the shank.

One problem encountered with fluked anchors is that the flukes can oftentimes become fouled or snagged within rocks or coral found on a lake or ocean floor. Because the shank and flukes of a conventional twin fluke-type anchor cooperate at a particular optimum holding angle, in order to hold anchorage the holding angle integrity must be maintained. Exceeding the holding angle when attempting to free the anchor often results in structural damage to the anchor. One solution to the problem as found in the prior art is to provide for reverse pull on the shank at an angle different than the holding angle. Many of the prior art devices with slide rings are unsatisfactory because of premature anchorage release. Other devices found in the prior art include complicated structural elements disposed in longitudinal slots in the shank which greatly reduced the structural integrity of the shank itself. For example, in U.S. Pat. No. 2,468,077, issued Apr. 26, 1949, Kelrum shows a twin fluke anchor having a shank with a longitudinally disposed slot which reduces the structural integrity of the shank. And yet other prior art devices show radically altered anchor structures which lose the advantages of the twin fluke-type design.

The present invention may be utilized with a solid shank found on a conventional twin fluke anchor which is readily installed on the shank without adversely affecting the holding ability or reliability of the anchor. The present invention includes a removable shear pin to provide a slide lock if desired to prevent accidental freeing of the anchor when moored.

BRIEF DESCRIPTION OF THE INVENTION

A shank-mounted fouled anchor release for providing reverse pull on the anchor comprising a slide housing moveably coupled around the anchor shank, a slide stop disposed and connected to the free end of the shank through the shank line receiving aperture, a clevis pivotally coupled to said slide housing, said clevis including shear pin apertures and a line receiving aperture for coupling the anchor to a line, said slide stop including a channel for receiving a shear pin and a means for connecting the stop to the shank body. The slide housing includes a shank receiving passage shaped to fit on the shank exterior and provides one or more passageways between the shank exterior surface and the interior wall surface of the slide housing to prevent slide fouling from sand. A removeable shear pin, in one mode of operation, locks the slide housing and clevis to the shank body, preventing actuation unless the shear pin is severed.

The device may be operated with or without the shear pin, dependent on the particular marine environment and mooring requirements. With the shear pin removed, the slide is free to move along the shank at all times. With the shear pin connected to the clevis and shank through the slide stop, the clevis is aligned with the longitudinal axis of the shank and is not free to pivot, maintaining the proper shank holding angle until it is severed by sufficient shear force.

The slide stop is a rigid tube having a central larger diameter segment and smaller diameter end segments and a channel disposed along its longitudinal axis which receives the shear pin. The larger diameter segment of the stop is sized to engage the end surface of the line receiving aperture or eye conventionally disposed at the free end of the shank.. The smaller diameter segments of the stop protrude laterally outwardly from the sides of the shank body and engage the slide housing, preventing its removal from the shank.

A slide stop retainer plate is engaged on each side of the shank body to the slide stop end segments and includes a first aperture for receiving a smaller diameter segment of the stop and a second aperture for receiving a suitable fastener connected through the shank body that holds the slide stop firmly in the conventional shank line receiving aperture. In operation, the smaller diameter end segments of the stop protruding outwardly away from the shank body sides engage the slide housing to prevent its removal from the free end of the shank.

The clevis walls include a pair of shear pin receiving apertures which align with the channel in the slide stop when the clevis is disposed along the shank longitudinal axis so that the shear pin when inserted is connected through the clevis walls and the slide stop.

The shear pin in one embodiment is a threaded bolt and includes a locking nut, permitting easy installation or removal. With the shear pin removed, the slide housing is free to move along the shank (between stops) and the clevis is free to pivot relative to the shank.

It is an object of this invention to provide an improved shank mounted fouled anchor release for providing reverse pull on a twin fluke-type anchor.

It is another object of this invention to provide a shank-mounted fouled anchor release which does not reduce the structural integrity of the shank.

But still yet another object of this invention is to provide a reverse pull anchor shank slide which is readily mounted on a conventional solid anchor shank which prevents slide jamming from sand or marine grit.

And yet still another object of this invention is to provide a fouled anchor release which is shank mounted and includes in one mode of operation a shear pin which when severed actuates the slide housing and clevis for reverse pull operation.

In accordance with these and other objects which will be apparent hereinafter, the instant invention will now be described with particular reference to the accompanying drawings.

BRIEF DESCRIPTION OF THE DRAWINGS

FIG. 1 shows a top plan view of the instant invention as attached to a conventional twin fluke anchor shank.

FIG. 2 shows the instant invention attached to an anchor shank end in a side elevational view with the shear pin installed, locking the slide housing and clevis along the longitudinal axis of the shank.

FIG. 3 is a side elevational view of the instant invention with the shear pin removed.

FIG. 4 is a top plan view partially in cross-section of the slide stop as connected in a conventional shank line receiving aperture with the removeable shear pin shown in an exploded view.

FIG. 5 shows a front end elevational view in the direction of the longitudinal axis of the anchor shank.

FIG. 6 is a cross-sectional view in elevation along line VI—VI of FIG. 2, in the direction indicated.

FIG. 7 is a cross-sectional view in elevation through line VII—VII shown in FIG. 2 in the direction indicated.

FIG. 9 shows the slide without the shear pin coupled to an anchor shank, showing the pivotal movement of the clevis.

PREFERRED EMBODIMENT OF THE INVENTION

Figure 8:
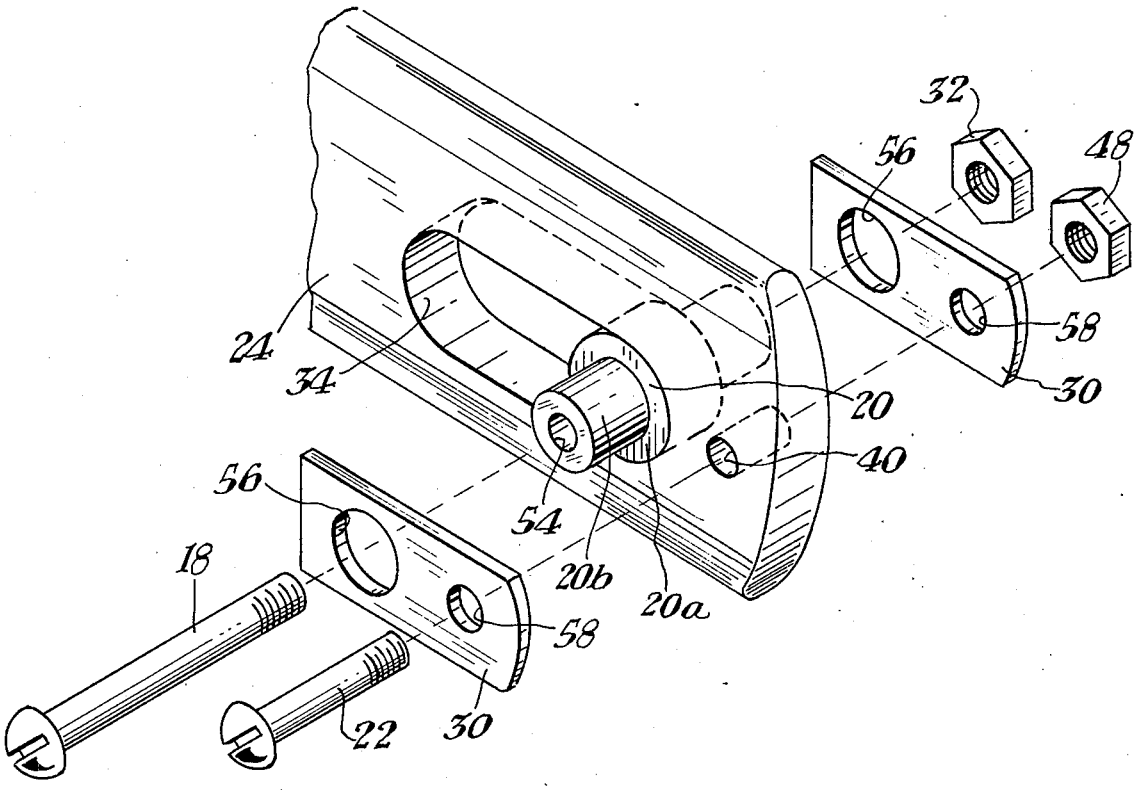
FIG. 8 is a perspective view, partially exploded, of the slide stop and shear pin utilized in one embodiment of the instant invention.

Referring now to the drawings and especially FIG. 1, the instant invention is shown generally at 10 coupled to the free end of shank 24 of a conventional twin fluke anchor 26 which includes a crown 28 and flukes 46. The device is comprised of a reverse-pull anchor slide having a slide housing 16 mounted around shank 24 and a pivotal clevis 12 connected by rivets 14 to opposite side walls of the slide housing 16, and a slide stop 20 fastened to shank 24 by retainer plates 30 and removeable fastener 22. As shown in FIG. 1, the slide housing 16 and clevis 12 are locked in position by a threaded removeable shear pin 18 and nut 32.

FIG. 2 shows the slide housing 16 and clevis 12 locked to shank 24 by shear pin 18 such that the clevis has an arm portion 12*a* that extends beyond and along the longitudinal axis of shank 24. The extended arm 12*a* includes a line receiving aperture 38 for connecting an anchor line to the anchor. With the shear pin 18 installed, the slide housing is held firmly against the stop 20, and the anchor functions conventionally until the shear pin 18 is severed, allowing the clevis to pivot and the slide housing 16 to move along the shank 24.

FIG. 3 shows the instant invention with the shear pin removed such that clevis 12 has been rotated toward the crown (not shown) and slide housing 16 has moved along shank 24 toward the anchor body. The slide stop 20 is held firmly within the conventional shank line receiving aperture 34 by stop retainer plates 30 connected to shank 24 by a threaded fastener 22. The slide stop 20 protrudes outwardly on each side of shank 24 a sufficient distance to engage a portion of the end face of slide housing 16, preventing the removal of the slide from shank 24.

FIG. 4 shows the slide stop 20 which is a rigid tube having a larger diameter center portion and smaller diameter end portions, the larger diameter portion engaging the end wall surface of conventional line receiving aperture 34 in shank 24. A small aperture 40 is placed in the shank 24 to receive threaded fastener 22 for connecting the slide stop retaining plates 30 to the shank 24. The retaining plates 30 are disposed on opposite sides of shank 24 and each plate has a first aperture which receives the smaller diameter end of the slide stop and a second aperture which receives fastener 22.

FIG. 5 shows the clevis 12 locked along the longitudinal axis of shank 24 by shear pin 18 and nut 32.

FIG. 6 shows a view along line VI—VI which shows slide housing 16 mounted around shank 24 with the clevis arms 12*b* locked by shear pin 18 and nut 32. The retainer plates 30 are held against the shank sides by fastener 22 and nut 48.

FIG. 7 shows a view of the slide housing 16 along line VII—VII which is substantially rectangular in shape to conform with the lateral sides of the shank to provide spaced passages 44 between the interior surface of the slide housing and the exterior surface of the shank side wall. Additional passages 42 are formed between the upper and lower interior wall surfaces of slide housing 16 and the tapered upper and lower edges of shank 24. The passages 42 and 44 allow for sand and marine grit to flow between the slide housing and the shank surfaces without jamming or retarding the slide action along the shank. The slide housing rides along the shank at contact wall portions 50 and 52.

FIG. 8 shows the slide stop 20 having the larger diameter center portion 20*a* which engages the shank line receiving aperture 34 and smaller diameter ends 20*b* which engage the slide housing preventing removal from the shank 24. The shear pin 18 is received through channel 54 in the slide stop 20. The retainer plates 30 include a first aperture 56 having a diameter equal to the diameter of the smaller end 20*b* of slide stop 20. The larger diameter center of the slide stop engages the retainer plates, preventing the stop from moving out of the shank aperture. Fastener 22 is received through a second aperture 58 in retaining plate 30 which secures the plate to the shank 24 on each side.

Referring back to FIG. 2, to operate the device with the shear pin 18 installed, the clevis, since it is locked and aligned with the longitudinal axis of shank 24, acts as an extension of the shank and does not interfere with the conventional holding angle of the anchor until the shear pin is severed. If the anchor becomes fouled, the anchor line is pulled until the shear pin 18 is severed, allowing the clevis 12 to pivot back towards the shank 24. Once the shear pin 18 is severed, the slide housing 16 is free to move backwards along the shank towards the anchor crown. Once the slide and clevis are established adjacent the crown of the anchor (which acts as the other slide stop), with the clevis pivoted, the entire anchor can be subjected to a reverse pull, freeing the flukes from rocks, coral or the like. With the shear pin installed, since the slide is locked in position along the shank, there is no danger of an accidental freeing of the anchor (by slide movement) which might result from tidal or wind changes affecting the position of the vessel.

Under some anchorage conditions, it may be desirous to operate without the shear pin in which case the clevis is free to rotate and the slide is free to move along the shank between the slide stop and the crown. Such an anchorage might be in a temporary anchorage in which rocks or coral are present.

With the use of the instant invention, a conventional anchor having a shank with a line receiving aperture can be readily modified by placing an additional small hole adjacent the line receiving aperture which allows the stop retainer plates and fasteners to be quickly mounted on the shank. With the slide stop which includes a shear pin receiving channel, the device may be operated in either two modes of operation as described above.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device, mountable on a conventional anchor shank having an aperture near its free end, to provide anchor line reverse pull on the anchor when fouled comprising:

shank slide mounted around and moveably along said shank exterior surface;

means connected to said slide for attaching an anchor line to said slide;

slide stop connected to the free end of said shank; and shearable fastening means connected to said slide and said shank for retaining said slide in a fixed position relative to said shank free end.

2. A device, as in claim 1, wherein said slide stop includes:

stop plug having a portion disposed in said shank aperture, said plug ends protruding outwardly from the lateral sides of said shank, said stop plug ends engageable with said slide; and stop plug retaining means connected to said stop plug body and said shank for holding said stop plug in said shank aperture.

3. A device, as in claim 2, wherein said slide stop includes:

stop plug having a shear pin receiving channel disposed therethrough; and a shear pin coupled to said slide and said shank.

4. A device, as in claim 3, wherein said slide includes:

slide housing mounted around said shank, said housing having a first interior wall portion engageable with said shank exterior wall surface and a second interior wall portion connected integrally with the first interior wall portion, said second interior wall portions forming a channel with said shank exterior wall portions.

5. A shank-mounted fouled anchor release, as in claim 4, wherein:

said slide stop is removeably coupled to said shank.

6. A shank mountable fouled anchor release for providing reverse pull on a fouled anchor comprising:

a shank mountable slide, said slide being moveably engageable with the exterior surface of said shank;

a clevis pivotally connected to the slide, said clevis including an anchor line attaching means;

shearably removeable fastener connected to said slide and said shank for holding said slide in a fixed position relative to said shank; and slide stop connected to the free end of said shank.

7. A shank-mounted anchor release, as in claim 6, including:

a removeable shear pin, said slide stop including a shear pin receiving channel and said clevis having a pair of supporting arms pivotally connected to said slide housing, each of said arms having a shear pin receiving aperture alignable with said slide stop channel, said shear pin receivable through said clevis apertures and said slide stop channel for locking said clevis and said slide to said shank.

8. A shank-mounted anchor release, as in claim 7, including:

a pair of slide stop retaining plates;

said slide stop being tubular and having a larger diameter center segment and smaller diameter end segments, each of said slide stop retaining plates having an aperture sized to engage and receive the smaller diameter end segments of said slide stop, said retaining plates connected to said shank.

9. A shank-mounted device, as in claim 8, including:

removeable fastener connecting said retainer plates to said shank.

10. A shank-mounted fouled anchor release, as in claim 9, wherein:

said slide housing includes a first interior wall portion engageable with said shank exterior wall surface and a second interior wall portion disposed outwardly from said first wall portion, said second wall portion forming a spaced passage between said slide housing and said shank exterior surface, said second wall portion engageable with said slide stop ends.

11. A shank-mounted device for providing reverse pull on an anchor comprising:

a shank slide, said slide including a rigid frame disposed around said shank, said frame engageable with a portion of said shank periphery, and a means for attaching an anchor line to said frame;

means for shearably fastening said slide to said shank; and a slide stop connected to said shank free end.

12. A device, as in claim 11, including:

means for locking said slide to said shank.

13. A device, as in claim 12, wherein:

said slide locking means includes a shear pin and a threadable connector attachable to said shear pin.

14. A shank-mounted device, as in claim 13, wherein:

said slide frame including a wall portion disposed away from the periphery of said shank forming a plurality of passageways between said wall portion and said shank periphery to allow the flow of sand or marine grit through said slide frame when said slide is moved along said shank.

15. A shank-mounted anchor release, as in claim 14, including:

a removeable fastener means connected to said slide stop for removeably connecting said slide stop to said anchor shank.

16. An anchor release, as in claim 15, wherein:

said slide stop includes a channel disposed therethrough, said channel adapted to receive said slide locking means.

17. A shank-mounted fouled anchor release comprising:

slide mounted around said shank, said slide having an inner wall portion which contacts said shank on at least two sides and a channel formed between the inside surface of said slide and the exterior surface of said shank to allow sand to flow between the slide and the shank;

slide stop connected to the free end of said shank, said slide stop including a first channel for receiving a shear pin;

shear pin connectable to said slide and slide stop;

shank extension having a pair of bifurcated arms adjacent one end, said bifurcated arms each being mounted on opposite sides of said slide; and means for mounting said shank extension bifurcated arms pivotally to said outside of said slide.

18. A device to provide reverse pull upon an anchor, said anchor having a shank with flukes pivotally mounted at one end and means permitting attachment of an anchor line at the free end, said device comprising:

a slide body having a passageway therethrough with interior walls shaped to engage said shank at a plurality of preselected points around the periphery thereof and to leave a plurality of open passages between said shank and slide body for the passage of sand or the like;

slide stop means removably coupled to the free end of said shank to retain said slide body upon said shank;

a bifurcated link means for attachment to an anchor line, means for pivotally connecting said link means to said slide body; and means for shearably connecting said link to said shank.

19. The device of claim 18 wherein said means permitting attachment of an anchor line to the free end of said shank comprising:

an aperture therein and wherein said stop means comprises a rigid member disposed through said aperture for engagement with said slide body and means for retaining said member in position for such engagement.

* * * * *